United States Patent [19]

Salvador et al.

[11] Patent Number: 4,804,344

[45] Date of Patent: Feb. 14, 1989

[54] CABLE CONNECTOR AND CRIMPING TOOL THEREFOR

[75] Inventors: Victor L. Salvador, Mamaroneck; John A. Triunfo, Yonkers, both of N.Y.

[73] Assignee: Kings Electronics Co., Inc., Tuckahoe, N.Y.

[21] Appl. No.: 74,135

[22] Filed: Jul. 16, 1987

[51] Int. Cl.[4] ..... H01R 4/10

[52] U.S. Cl. ..... 439/877; 29/566.3; 29/753

[58] Field of Search ..... 439/95, 98, 99, 108, 439/578–585, 877, 878, 879, 880, 881, 882, 675; 29/33 M, 566.3, 753, 863, 564.2, 751, 761, 863, 517; 72/326, 402, 325; 81/304

[56] References Cited

U.S. PATENT DOCUMENTS

| | | | |
|---|---|---|---|
| 3,217,519 | 11/1965 | Demler | 81/304 |
| 3,281,756 | 10/1966 | O'Keefe et al. | 439/99 |
| 3,484,922 | 12/1969 | Fritz et al. | 29/753 |
| 3,923,367 | 12/1975 | Carter | 439/585 |
| 4,019,236 | 4/1977 | Osman | 29/753 |
| 4,336,646 | 6/1982 | Feldman | 72/402 |

OTHER PUBLICATIONS

"Assembly Procedure for Coaxicon Disconnect", AMP (1–1959), p. 6.

*Primary Examiner*—David Pirlot
*Attorney, Agent, or Firm*—Jordan B. Bierman

[57] ABSTRACT

A cable connector having an outer body, a center contact, and an insulator between the contact and the body wherein the contact is adapted to receive a center wire. The connector has at least one off-center hole in the outer body extending substantially parallel to the center contact and located adjacent an external surface of the outer body. The off-center hole is adapted to receive an outer wire. The center contact and the off-center hole are adapted to be crimped by a center crimp pin and an outer crimp pin, respectively, both carried by a crimping tool.

4 Claims, 2 Drawing Sheets

CABLE CONNECTOR AND CRIMPING TOOL THEREFOR

The present invention is directed to the field of crimpable cable connectors, more specifically, to a form of center connector wherein two wires may be crimped in place simultaneously.

Since cable connectors normally are installed in the field, it is advantageous to provide a simple method for crimping the wires into the connector. While the present invention will be described with specific reference to a connector for termination of two hook-up wires and a crimping tool therefor, it will be readily appreciated that the invention may be applied in many other related areas.

The cable connector of the present invention comprises an outer body, a center contact, and an insulator therebetween. The contact is adapted to receive a center wire. There is at least one off-center hole in the outer body which extends substantially parallel to the center contact and is located adjacent an external surface of the outer body. An outer wire is inserted into this hole. Once the wires are in place, the center contact and the off-center hole are adapted to be crimped by the crimping tool of the present invention.

The tool comprises a first die, a center crimp pin on a first portion of the first die, and an outer crimped pin on a second portion of the first die. Means for pressing the center crimp pin and the outer crimp pin against the corresponding center contact and off-center hole of the cable connector is provided. The center crimp pin bears against and crimps the center contact and the outer crimp pin, in an anlogous manner, crimps the off-center hole.

The means for pressing the pins against the appropriate portions of the connector are well known. The usual "scissors" arrangement is entirely suitable. Alternatively, the die may be placed in a drill press and urged against the connector. The pressure could even be exerted manually, if desired.

In a preferred form of the connector, there are one or two center crimp holes substantially perpendicular to the center contact and terminating adjacent thereto. If there are two center crimp holes, they are spaced 180° from each other. The crimping tool preferably carries center crimp pins corresponding in number and location to the center crimp holes on the connector. Of course, since the off-center holes are located near the surface of the connector, it is possible to simply press the outer crimp pin of the tool against the outer surface of the connector adjacent the off-center hole in order to crimp the outer wire in the off-center hole.

In another preferred form of the device, the portion of the connector surrounding the center contact has a substantially smaller diameter than the portion surrounding the off-center holes. The crimping tool is then made to correspond to the two different diameters and provide the appropriate pressure on both the center contact and the off-center hole so that crimping can take place in a single operation.

In a further modification of this device, the smaller diameter can be reduced sufficiently so that no center crimp hole is required. As in the case of the off-center hole, the pressure of the tool will be sufficient to cause the necessary crimping.

In the accompanying drawings, constituting a part hereof, and in which like reference characters indicate like parts, FIG. 1 is a section view showing the crimping tool and the connector of the present invention;

Figure 1:
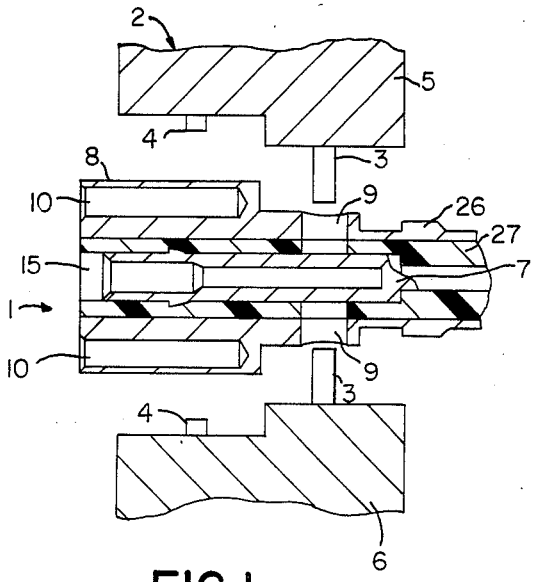
Figure 2:
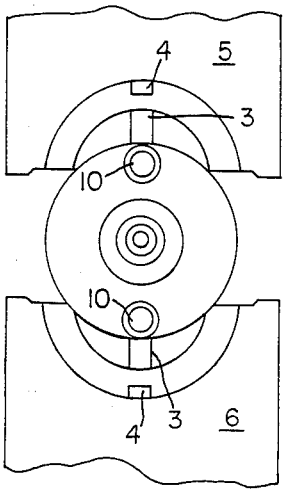
FIG. 2 is an end view of FIG. 1.
Figure 3:
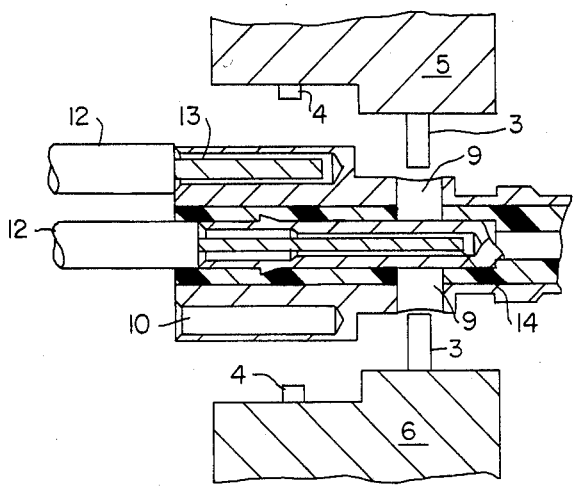
FIG. 3 is a view similar to that of FIG. 1, with the wires in place.

Referring particularly to FIGS. 1 to 3, connector 1 is shown with crimping tool 2. Connector 1 comprises outer body 8, reduced part 26, insulator 27 and center contact 7. Insulator 27 electrically isolates body 8 from contact 7. Center wire 11 is inserted into center hole 15 and bare wire 14 extends into contact 7. In similar fashion, outer wire 12 is placed against the rear face of body 8 so that bare outer wire 13 extends into at least one of holes 10. In the preferred form of the device, center crimp holes 9 extend from the surface of reduced part 26 to center contact 7.

Figure 4:
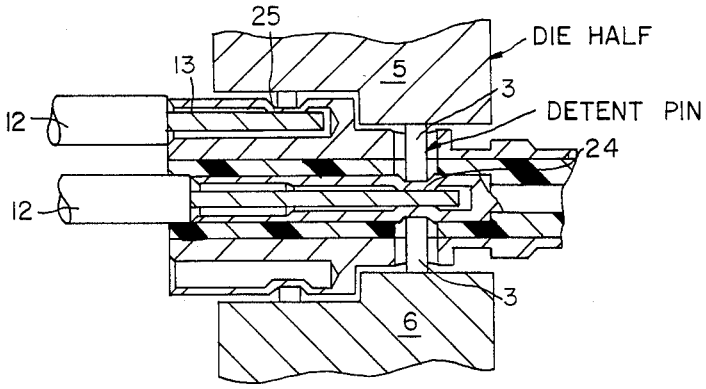
FIG. 4 is a view similar to FIG. 3 wherein the crimp has been completed.

The crimping tool comprises dies 5 and 6 provided with center crimp pins 3 and outer crimp pins 4. As can be seen from the drawings, dies 5 and 6 have a shape which is complementary to the shape of connector 1. Means (not shown) is provided for urging dies 5 and 6 together so that pins 3 and 4 will bear against connector 1 and cause center crimp 24 and outer crimp 25 (as shown in FIG. 4).

In operation, bare wires 13 and 14 are inserted into holes 10 and 15, respectively. Dies 5 and 6 are positioned so that pins 3 are located adjacent holes 9 and pins 4 are adjacent holes 10. Dies 5 and 6 are then pressed together and pins 3 crimp center contact 7 and one of pins 4 crimps hole 10. In this manner, both wires 11 and 12 are secured to connector 1, while being kept in electrical isolation from each other.

While only a limited number of specific embodiments of the present invention have been expressly disclosed, it is, nonetheless, to be broadly construed and not to be limited except by the character of the claims appended hereto.

What we claim is:

1. A cable connector comprising an outer body, a center contact, and an insulator between said contact and said body, said contact adapted to receive a center wire, at least two off-center holes in said outer body extending substantially parallel to said center contact and located adjacent an external surface of said outer body, said off-center holes adapted to receive an outer wire, said center contact and said external surface adapted to be crimped by a center crimp pin and an outer crimp pin, respectively, both carried by a crimping tool.

2. The connector of claim 1 wherein said crimping tool carries two outer crimp pins.

3. The connector of claim 1 wherein there are two off-center holes located approximately 180° apart and said crimping tool carries two outer crimp pins.

4. The connector of claim 1 wherein said holes are approximately 180° apart.

* * * * *